US012091972B1

(12) United States Patent
Zeng et al.

(10) Patent No.: US 12,091,972 B1
(45) Date of Patent: Sep. 17, 2024

(54) METHOD AND DEVICE FOR DETERMINING DEVELOPMENT STATUS OF SEPARATION LAYER OF COAL MINE

(71) Applicant: CHINA UNIVERSITY OF MINING AND TECHNOLOGY, BEIJING, Beijing (CN)

(72) Inventors: Yifan Zeng, Beijing (CN); Aoshuang Mei, Beijing (CN); Qiang Wu, Beijing (CN); Huaming Wei, Beijing (CN); Yashuai Cui, Beijing (CN); Shihao Meng, Beijing (CN); Weihong Yang, Beijing (CN); Kai Pang, Beijing (CN); Liang Yang, Beijing (CN); Yidi Xing, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/596,373

(22) Filed: Mar. 5, 2024

(30) Foreign Application Priority Data

May 11, 2023 (CN) ..... 202310531801.X

(51) Int. Cl.
*E21C 41/18* (2006.01)
*E21C 39/00* (2006.01)
*E21F 17/18* (2006.01)

(52) U.S. Cl.
CPC ..... *E21C 41/18* (2013.01); *E21C 39/00* (2013.01); *E21C 2100/00* (2023.05); *E21F 17/18* (2013.01)

(58) Field of Classification Search
CPC ..... E21C 2100/00; E21C 39/00; E21C 41/18; E21F 16/00; E21F 16/02; E21F 17/00; E21F 17/18; E21F 17/185; G01V 20/00
See application file for complete search history.

(56) References Cited

U.S. PATENT DOCUMENTS

2020/0370433 A1* 11/2020 Li ..... E21C 41/18

FOREIGN PATENT DOCUMENTS

CN 106968713 A 7/2017
CN 109884055 A 6/2019
CN 111382504 A 7/2020
(Continued)

OTHER PUBLICATIONS

Gui HR, Tong SJ, Qiu WZ, Lin ML (2018b) Research on preventive technologies for bed-separation water hazard in China coal mines. Appl Water Sci. https://doi.org/10.1007/s13201-018-0667-0 (Year: 2018).*

(Continued)

*Primary Examiner* — Christopher J Sebesta
*Assistant Examiner* — Michael A Goodwin
(74) *Attorney, Agent, or Firm* — Westbridge IP LLC

(57) ABSTRACT

Disclosed are a method and a related device for determining a development status of a separation layer in a coal mine. The method includes: obtaining surface subsidence variation data of the coal mine within a preset time interval, rock stress variation data of a caving zone of the coal mine and water pressure variation data; determining a height decrease of the caving zone based on the rock stress variation data and the water pressure variation data; and determining the development status of the separation layer of the coal mine based on the height decrease and the surface subsidence variation data.

5 Claims, 2 Drawing Sheets

(56) References Cited

FOREIGN PATENT DOCUMENTS

| | | | | | |
|---|---|---|---|---|---|
| CN | 112560226 | A | | 3/2021 | |
| CN | 112983549 | A | | 6/2021 | |
| CN | 113217103 | A | * | 8/2021 | ..... E21F 17/18 |
| CN | 114637957 | A | | 6/2022 | |
| CN | 115234298 | A | * | 10/2022 | |
| SU | 1610055 | A1 | | 11/1990 | |
| WO | WO-2018233329 | A1 | * | 12/2018 | ..... E21B 33/138 |
| WO | WO-2022188274 | A1 | * | 9/2022 | ..... G01C 5/00 |

OTHER PUBLICATIONS

Gui HR, Lin ML, Song XM (2018a) Identification and application of roof bed separation (water) in coal mines. Mine Water Environ. https://doi.org/10.1007/s10230-018-0518-0 (Year: 2018).*

First Office Action issued in counterpart Chinese Patent Application No. 202310531801.X, dated Nov. 4, 2023.

* cited by examiner

METHOD AND DEVICE FOR DETERMINING DEVELOPMENT STATUS OF SEPARATION LAYER OF COAL MINE

CROSS-REFERENCE TO RELATED APPLICATIONS

This application claims priority to Chinese Patent Application No. 202310531801.X, filed on May 11, 2023, the content of which is incorporated herein by reference in its entirety.

TECHNICAL FIELD

The present disclosure relates to a technical field of water control in coal mining, in particular to a method and a related device for determining a development status of a separation layer in a coal mine.

BACKGROUND

In coal mining, water inrush accidents may occur frequently due to influences of aquifers in a seam roof of a coal mine and there are no clear warning signs would be given. However, once such an accident occurs, it will cause serious casualties and significant economic losses.

The key of water control in coal mining is prevention. Therefore, it is necessary to determine a development status of a separation layer in a coal mine. After the development status of the separation layer is determined, effective measures can be taken in advance to prevent water inrush accidents.

SUMMARY

In view of the above, the present disclosure provides a method and a related device for determining a development status of a separation layer in a coal mine. By the method and device provided, the development status of the separation layer in the coal mine can be determined accurately.

According to examples of the present disclosure, the method for determining a development status of a separation layer in a coal mine may include the following steps: obtaining surface subsidence variation data of the coal mine within a preset time interval, rock stress variation data and water pressure variation data of a caving zone corresponding to a ground surface of the coal mine; determining a height decrease of the caving zone based on the rock stress variation data and the water pressure variation data; and determining the development status of the separation layer of the coal mine based on the height decrease of the caving zone and the surface subsidence variation data.

Based on the above method, an electronic device is also provided, which may include: a memory, a processor, and a computer program stored in the memory and executable on the processor, where the processor executes the computer program to implement the method for determining a development status of a separation layer in a coal mine.

Based on the same inventive concept, corresponding to the methods according to any one of the foregoing examples, the present disclosure further provides a non-transient computer readable storage medium which stores a computer instruction used for enabling the computer to perform the method for determining a development status of a separation layer in a coal mine according to any one of the examples.

As can be seen from the above disclosed method and related device for determining the development status of the separation layer in the coal mine, the surface subsidence variation data of the coal mine within the preset time interval, the rock stress variation data of the caving zone of the coal mine, and the water pressure variation data can be obtained at first. Then, the height decrease of the caving zone can be determined based on the rock stress variation data and the water pressure variation data. Finally, the development status of the separation layer of the coal mine can be determined based on the height decrease of the caving zone and the surface subsidence variation data.

The method and device disclosed can utilize the rock stress variation data and the water pressure variation data of the caving zone comprehensively to monitor the height of the caving zone. Moreover, by comparing and analyzing the height of the caving zone, the development status of the separation layer in the caving zone can be determined accurately. In this way, the probability of an occurrence of any water damage accidents in the separation layer can be reduced. Thus the safety of coal mine productions can be improved significantly, and the development of the coal industry can be further promoted. Moreover, by the method and device disclosed the cost of determining the development status of the separation layer can be reduced effectively.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
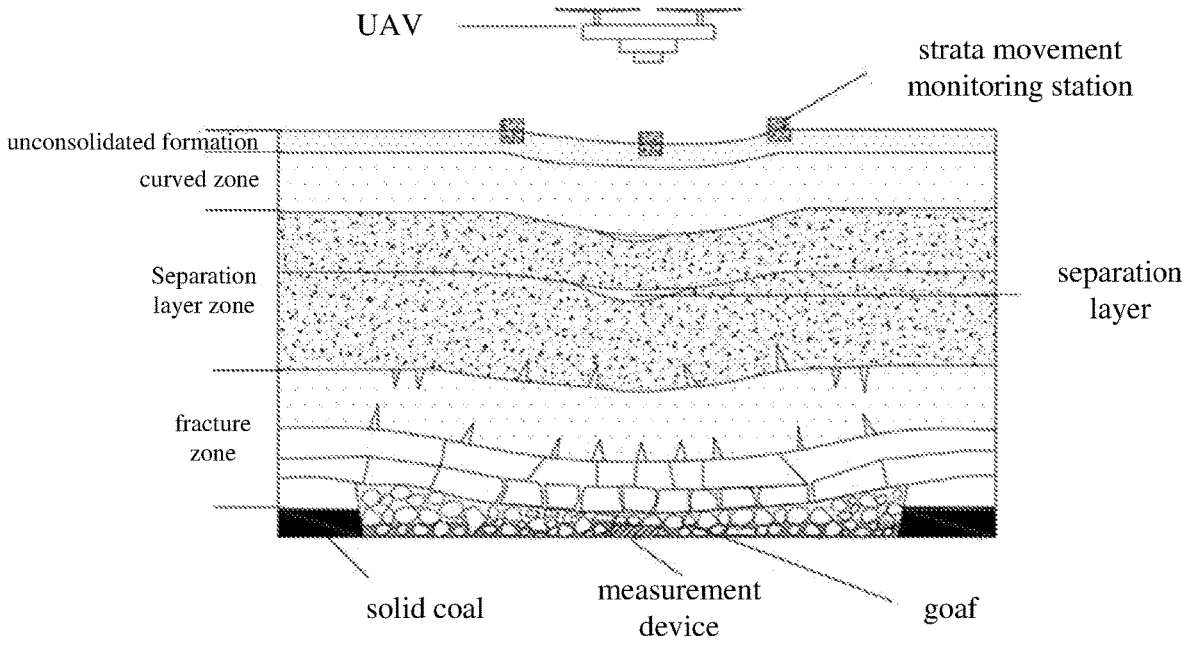
FIG. 1 is a schematic diagram illustrating a development status of a separation layer in a coal mine according to an example of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As described in the background, during the process of mining thick coal seams, a caving zone may be formed because overlying rock layers in the goaf may sink gradually. Due to differences in rock types, different types of rock may sink in different speeds. Therefore, separation layers which can be regarded as cavities may be formed. At the same time, a large number of fractures may be generated in the subsidence rock layers from bottom to top, which may extend upwards continuously and penetrate aquifers such as the Jurassic Zhiluo Formations and the Cretaceous Luohe Formations. Therefore, pore water in the sandstones in the aquifers may gather gradually towards the separation layers along water conducting fractures. Due to a certain water blocking effect of mudstone strata, the accumulated water in the separation layers will become more and more over time. Therefore, a force on bottom rocks of the separation layers from the accumulated water may become stronger gradually. As an overlying rock damage caused by mining activities continues, when a balance between the gravity of the accumulated water in a separation layer and a support force of a rock layer at the bottom of the separation layer is disrupted, the accumulated water in the separation layer will break through the weakest part of the rock layer at the bottom of the separation layer and suddenly burst out. The accumulated water then may flow into a working face of the goaf (usually from both ends or from a low concave part of the working face). That is, a water inrush accident may occur. As described above, the water inrush accident may cause serious damages in a short period of time, and even bring secondary disaster risks such as gas exceeding limits.

Those skilled in the art may know, for water accumulations in a separation layer, due to its strong concealment, the accuracy of numerical simulation and analysis methods used to determine the development status of the separation layer is not sufficient. Therefore, it is hard to predict a water inrush. Moreover, conventional drilling processes are limited by on-site conditions and the cost is usually too high. Therefore, how to determine the development status of the separation layer in a goaf of the coal mine accurately has become an urgent problem to be solved.

In view of the above, the present disclosure provides a method and a related device for determining a development status of a separation layer in a coal mine. By the method and device provided, the development status of the separation layer in the coal mine can be determined accurately.

In the following, the technical solution of the method and related device will be further explained in detail through specific examples.

FIG. 1 is a schematic diagram illustrating a development status of a separation layer in a coal mine according to an example of the present disclosure.

As shown in FIG. 1, in a process of underground coal mining, due to uneven settlements of rock layers, horizontal cracks may be formed at contact surfaces of the rock layers. Later, as the coal mining working face continues to expand, the surface of the goaf may further expand accordingly. In this process, the span and subsidence of the rock layers above the goaf may further increase. Therefore, tensile fractures may occur eventually, and vertical cracks may also be formed. At the same time, some horizontal cracks may be destroyed. In these cracks, the horizontal cracks that are not penetrated by vertical cracks may form enclosed cavities. That is, in such a horizontal crack, a water storage space can be formed to accumulate pore water, which can be called a separation layer.

In the present disclosure, surface subsidence variation data of the coal mine surface can be measured by setting up a rock movement monitoring station on the surface of the coal mining working face centerline. In other examples, the surface subsidence variation data can be monitored by at least one Unmanned Aerial Vehicles (UAV). The use of the UAV can greatly improve the accuracy of the surface subsidence variation data obtained. Furthermore, stress measurement devices and water pressure measurement devices can be buried in the caving zone on the centerline of the goaf.

In examples of the present disclosure, the stress measurement devices can be evenly spaced on the centerline of the goaf floor along with the mining progress. Specifically, the stress measurement devices can be placed directly at the bottom of the goaf. Moreover, data cables can be connected to a host through waterproof protective sleeves.

Moreover, a water level gauge in a water pressure measurement device can move along a waterproof sleeve to monitor a water level at any position.

Figure 2:
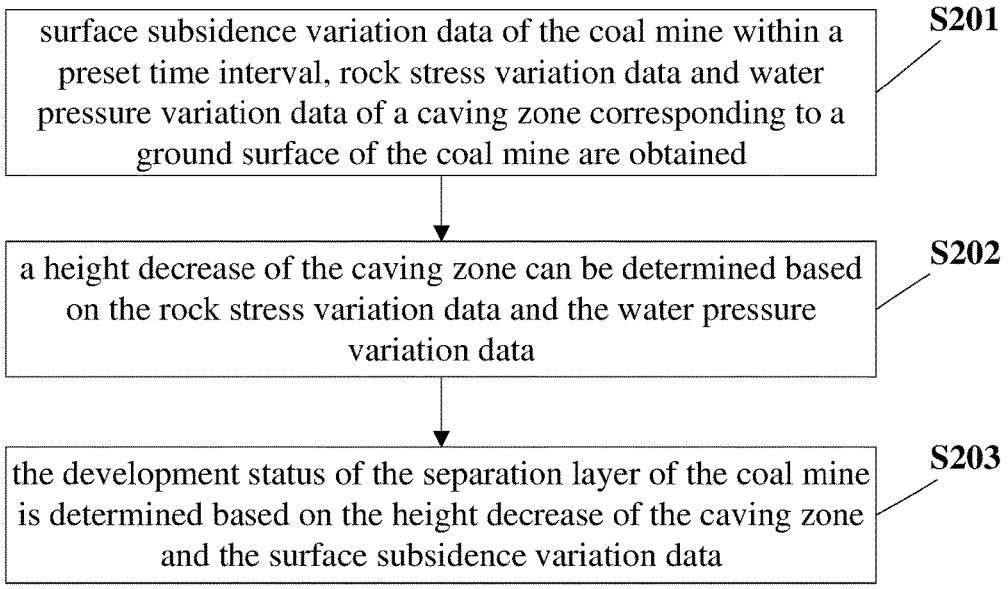
FIG. 2 is a schematic diagram illustrating a method for determining a development status of a separation layer in a coal mine according to an example of the present disclosure.

FIG. 2 is a schematic diagram illustrating a method for determining a development status of a separation layer in a coal mine according to an example of the present disclosure.

As shown in FIG. 2, the method for determining a development status of a separation layer in a coal mine may include the following steps.

In step S201, surface subsidence variation data of the coal mine within a preset time interval, rock stress variation data and water pressure variation data of a caving zone corresponding to a ground surface of the coal mine are obtained.

In some examples of the present disclosure, the ground surface can be monitored through a continuous photographing of one or more UAVs. The surface subsidence variation data then can be obtained by comparing and analyzing images of the ground surface photographed by the one or more UAVs.

Alternatively, in some other examples of the present disclosure, the rock movement monitoring station can obtain coordinates of one or more strata movement monitoring stations continuously. In this example, the surface subsidence variation data can be obtained by calculating changes in a Z-axis direction of the coordinates.

Specifically, a preset time interval can be set. By the strata movement monitoring station, a first coordinate of the strata movement monitoring station on the ground surface can be determined at a starting time of the preset time interval. Furthermore, a second coordinate of the strata movement monitoring station on the ground surface at an end time of the preset time interval can be determined too. Based on the first coordinate and the second coordinate, the surface subsidence variation data of the coal mine can be determined. To be noted, the first coordinate and the second coordinate may be coordinates in the Z-axis direction.

In some examples of the present disclosure, when a rock in the caving zone undergoes changes, pre-arranged stress measurement devices will be squeezed. Moreover, the water pressure measurement device will be arranged with through holes uniformly, through which groundwater can flow in. Therefore, it is possible to monitor the rock stress and the water pressure in the caving zone through the stress measurement devices, the water pressure measurement devices, data cables and the host.

In step S202, a height decrease of the caving zone can be determined based on the rock stress variation data and the water pressure variation data.

Specifically, in some examples of the present disclosure, the height decrease of the caving zone can be determined by the following steps: first, determining a maximum development height of the caving zone at first; second, determining a total stress of the caving zone based on the maximum development height of the caving zone; and then determining the height decrease of the caving zone based on the total stress of the caving zone, the maximum development height of the caving zone, the rock stress variation data and the water pressure variation data.

In an example of the present disclosure, to determine the maximum development height of the caving zone, an intensity of pressure of the caving zone should be calculated at first. Specifically, the intensity of pressure of the caving zone can be determined by calculating a summation of a product of a unit weight and a thickness of each layer of the caving zone.

That is, the intensity of pressure of the caving zone can be calculated according to the following formula:

$$P = \sum_{i=1}^{n} \gamma_i s_i$$

Here, P refers to the intensity of pressure of the caving zone, specified in Pa; $\gamma_i$ refers to a unit weight of an $i^{th}$ layer of the caving zone, specified in N/m3; $s_i$ refers to a thickness of the $i^{th}$ layer of the caving zone, specified in m (meter); and n refers to a total number of layers of the caving zone.

To be noted, the unit weight and the thickness of each layer of the caving zone can be measured by engineering geological exploration drilling and core testing. Therefore, the intensity of pressure of the caving zone can be determined.

Moreover, when the intensity of pressure P that a bottom plate of the caving zone experiences within the preset time interval (counted as $P_0$) remains stable and it is less than or equal to a summation of the intensities of pressure from the $1^{st}$ to the $n^{th}$ layer of caving zone, the maximum development height of the caving zone H can be calculated by the following formula:

$$H = \sum_{i=1}^{n-1} s_i + \frac{P_0 - \Sigma_{i=1}^{n-1} \gamma_i s_i}{\gamma_n}$$

That is, $$H = \sum_{i=1}^{n-1} s_i + \frac{P_0 - P}{\gamma_n}$$

Here, $P_0$ refers to a stable intensity of pressure that a bottom plate of the caving zone experiences within the preset time interval; $\gamma_n$ refers to a unit weight of a $n^{th}$ layer of the collapsed rock mass; and H refers to the maximum development height of the caving zone.

As disclosed above, after the maximum development height of the caving zone is determined, the total stress of the caving zone can be determined based on the maximum development height of the caving zone.

Due to the fact that the caving zone is filled with crushed stones, which belong to porous media. Those skilled in the art may know that effective stress principle of a porous media can be presented as:

$$\sigma_{ij}=(1-r)\sigma_{ij}^{s}+rp\delta_{ij}$$

Here, $\sigma_{ij}$ refers to the total stress, specified in Pa; r refers to a porosity of the porous media; $\sigma_{ij}^{s}$ refers to a stress between solid particles, that is, the stress between crushed stones in the caving zone, which is also the stress measured by the stress measurement device, specified in Pa; p refers to a pore fluid pressure, that is, the pore water pressure in the caving zone, which is also the stress measured by the water pressure measurement device, specified in Pa; and $\delta_{ij}$ refers to a Neroneck function, when i=j, $\delta_{ij}=1$; when i≠j, $\delta_{ij}=0$.

Furthermore, the effective stress of the solid particle skeleton can be defined as Terzaghi effective stress, that is, $\sigma_{ij}'=(1-r)\sigma_{ij}^{s}$, and the Terzaghi effective stress can be expressed as:

$$\sigma_{ij}'=\sigma_{ij}-rp\delta_{ij}$$

In examples of the present disclosure, when the caving zone develops to a highest point, the porosity of the goaf at this time should be considered as an initial porosity of the porous medium. At this time, the initial porosity $r_0$ of the block (calculated as V) within a cube range taking the stress measurement device as the bottom and taking the top of the caving zone as the top can be calculated using the following formula:

$$r_0 = \frac{M}{H + M} \times 100\%$$

Here, M refers to a mining height where a stress measurement device or a water pressure measurement device locates; H refers to the maximum development height of the caving zone; and $r_0$ refers to an initial porosity of blocks within a cubic range in the goaf of the coal mine.

In this example, the total stress of the caving zone can be calculated based on the following formula:

$$\sigma_{ij}=(1-r_0)P_0+r_0p_0$$

Here, $P_0$ refers to the stable intensity of pressure that a bottom plate of the caving zone experiences within the preset time interval; $p_0$ refers to a pore water pressure in the goaf when the maximum development height of the caving zone is reached; $\sigma_{ij}$ refers to the total stress of the caving zone.

During the mining process of the coal mine, the caving zone will be compacted gradually. In this process, the total stress $\sigma_{ij}$ can be deemed as unchanged; the porosity r can be deemed as decreasing gradually; and the stress P between solid particles and the pore water pressure p can be deemed as continuing to change.

At this point, the porosity $r_i$ at a certain moment i can be calculated using the following formula:

$$r_i = \frac{P_i - \sigma_{ij}}{P_i - p_i}$$

Here, $P_i$ refers to the rock stress variation data; $p_i$ refers to the water pressure variation data; and $\sigma_{ij}$ refers to the total stress of the caving zone.

Furthermore, the relationship between a porosity ratio ε and the porosity r is:

$$\varepsilon = \frac{r}{1-r}$$

Furthermore, based on the porosity $r_i$ at a certain moment i, as well as the relationship between the porosity ratio ε and the porosity r, a pore volume $V_i$ of block V corresponding to the moment i during the compaction process of the caving zone can be obtained, which can be expressed by the following formula:

$$V_i = \frac{P_i - \sigma_{ij}}{\sigma_{ij} - p_i} AH$$

Here, A refers an area of the surface of the stress measurement device.

Furthermore, a difference ΔV between $V_i$ and the pore volume corresponding to the maximum height of the caving zone can be represented as follows:

$$\Delta V = AM - \frac{P_i - \sigma_{ij}}{\sigma_{ij} - p_i} AH$$

Based on the area of the surface of the stress measurement device, the height decrease Δh of the caving zone at the stress measurement device at the moment i can be obtained by the following formula:

$$\Delta h = M - \frac{P_i - \sigma_{ij}}{\sigma_{ij} - p_i} H$$

Here, $P_i$ refers to the rock stress variation data; $p_i$ refers to the water pressure variation data; $\sigma_{ij}$ refers to the total stress of the caving zone; H refers to the maximum development height of the caving zone; M refers to the mining height where the stress measurement device or the water pressure measurement device locates; and Δh refers to the height decrease of the caving zone.

In S203, the development status of the separation layer of the coal mine is determined based on the height decrease of the caving zone and the surface subsidence variation data.

In some examples of the present disclosure, the development status of the separation layer of the coal mine may include an undeveloped status or a developed status in view of identifying whether there is a separation layer.

In some examples of the present disclosure, once the height decrease of the caving zone and the surface subsidence variation data are determined, the development status of the separation layer of the coal mine can be determined based on the height decrease of the caving zone and the surface subsidence variation data.

Based on measurement errors and actual conditions, there may be errors in the height decrease of the caving zone and the surface subsidence variation data. Therefore, a preset threshold can be designed according to actual situations. In examples of the present disclosure, the preset threshold can be flexibly set according to a current level of coal mining, a geology and/or a geographical location of the coal mine.

Specifically, in response to determining a difference between the height decrease of the caving zone and the surface subsidence variation data is less than the preset threshold, the separation layer of the coal mine can be determined as in the undeveloped status. Moreover, in response to determining the difference between the height decrease and the surface subsidence variation data is larger than or equal to the preset threshold, the separation layer of the coal mine can be determined as in the developed status.

Further, in some examples of the present disclosure, if the separation layer of the coal mine is determined as in the developed status, a development degree of the separation layer can be further determined. Specifically, the difference between the height decrease and the surface subsidence variation data can be set as a height of the separation layer of the coal mine. Then, the development degree of the separation layer can be further determined according to the height of the separation layer of the coal mine.

In specific implementations, the above disclosed method can also be used to predict an occurrence of water damages in the caving zone based on the development degree of the separation layer of the coal mine. When the development degree reaches a preset early warning threshold, control measures can be taken for the caving zone to avoid the occurrence of any water damages. In addition, since the water inrush from the overlying strata of the coal seam roof can be regarded as a dynamic process from formations of the separation layers, developments of the separation layers, accumulations of water in the separation layers to a water inrush, a life cycle of a water damage can be predicted based on the development status of the separation layers determined according to the method disclosed. In this way, water damages from the separation layers can be further prevented and controlled.

As can be seen from the disclosed method for determining a development status of a separation layer in a coal mine, the surface subsidence variation data of the coal mine within the preset time interval, the rock stress variation data of the caving zone of the coal mine, and the water pressure variation data can be obtained at first. Then, the height decrease of the caving zone can be determined based on the rock stress variation data and the water pressure variation data. Finally, the development status of the separation layer of the coal mine can be determined based on the height decrease and the surface subsidence variation data.

The method disclosed can utilize the rock stress variation data and the water pressure variation data of the caving zone comprehensively to monitor the height of the caving zone. Moreover, by comparing and analyzing the height decrease of the caving zone, the development status of the separation layer in the caving zone can be determined accurately. In this way, the probability of an occurrence of any water damage accidents in the separation layer can be reduced, the safety of coal mine production can be improved significantly, and the development of the coal industry can be further promoted. Moreover, the cost of determining the development status of the separation layer can be reduced effectively.

It should be noted that the method according to examples of the present disclosure may be performed by a single device, such as a computer or server. Moreover, the method according to examples of the present disclosure can also be applied to a distributed scenario, where the method can be implemented through cooperation of multiple devices. In the case of such a distributed scenario, one device of the plurality of devices may only perform one or more steps of the method, and the plurality of devices may interact with each other to perform the described method.

It is noted that some examples of the present disclosure have been described above. Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

Figure 3:
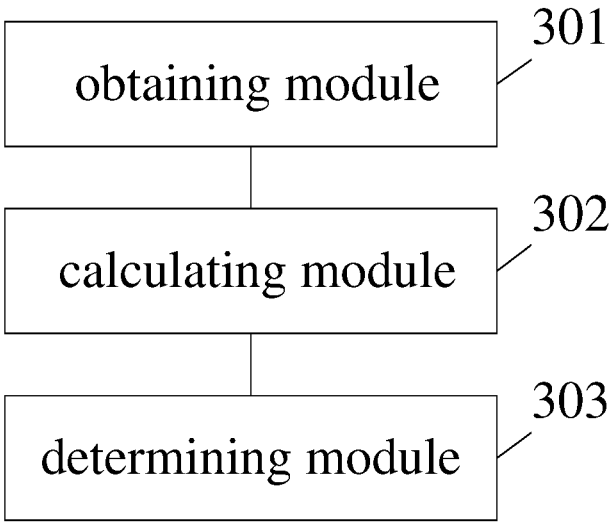
FIG. 3 is a schematic diagram illustrating a structure of a device for determining a development status of a separation layer in a coal mine according to an example of the present disclosure.

Based on the same concept, the present disclosure also provides a device for determining a development status of a separation layer in a coal mine corresponding to any of the aforementioned examples. FIG. 3 is a schematic diagram illustrating a structure of a device for determining a development status of a separation layer in a coal mine according to an example of the present disclosure. According to FIG. 3, the device may include the following modules.

An obtaining module 301, for obtaining surface subsidence variation data of the coal mine within a preset time interval, rock stress variation data of a caving zone on a ground surface of the coal mine, and water pressure variation data.

A calculating module 302, for determining a height decrease of the caving zone based on the rock stress variation data and the water pressure variation data.

A determining module 303, for determining the development status of the separation layer of the coal mine based on the height decrease and the surface subsidence variation data.

In some examples of the present disclosure, the development status of the separation layer of the coal mine may include: an undeveloped status or a developed status.

In some examples of the present disclosure, the determining module 303 may be further configured to: in response to determining a difference between the height decrease and the surface subsidence variation data is less than a preset threshold, determine the development status is the undeveloped status; and in response to determining the difference between the height decrease and the surface subsidence variation data is larger than or equal to the preset threshold, determine the development status is the developed status.

In some examples of the present disclosure, the obtaining module 301 may be further configured to: determine a first coordinate of the ground surface of the coal mine at a starting time of the preset time interval; determine a second coordinate of the ground surface of the coal mine at an end time of the preset time interval; and obtain the surface subsidence variation data according to the first coordinate and the second coordinate.

In some examples of the present disclosure, the calculating module 302 may be further configured to: calculate the maximum development height of the caving zone according to the following formulas:

$$P = \sum_{i=1}^{n} \gamma_i s_i$$

$$H = \sum_{i=1}^{n-1} s_i + \frac{P_0 - P}{\gamma_n}$$

Here, P refers to an intensity of pressure of the caving zone, specified in Pa; $\gamma_i$ refers to a unit weight of a $i^{th}$ layer of the caving zone, specified in N/m3; $s_i$ refers to a thickness of the $i^{th}$ layer of the caving zone, specified in m; n refers to a total number of layers of the caving zone; $P_0$ refers to a stable intensity of pressure that a bottom plate of the caving zone experiences within the preset time interval; $\gamma_n$ refers to a unit weight of a $n^{th}$ layer of the collapsed rock mass; H refers to the maximum development height of the caving zone.

In some examples of the present disclosure, the calculating module 302 may be further configured to: calculate the total stress of the caving zone according to the following formulas:

$$r_0 = \frac{M}{H + M} \times 100\%$$

$$\sigma_{ij} = (1 - r_0)P_0 + r_0 p_0$$

Here, M refers to a mining height where a stress measurement device or a water pressure measurement device locates; H refers to the maximum development height of the caving zone; $r_0$ refers to an initial porosity of blocks within a cubic range in a goaf of the coal mine; $P_0$ refers to the stable intensity of pressure that a bottom plate of the caving zone experiences within the preset time interval; $p_0$ refers to a pore water pressure in the goaf when the maximum development height of the caving zone is reached; $\sigma_{ij}$ refers to the total stress of the caving zone.

In some examples of the present disclosure, the calculating module 302 may be further configured to: calculate the height decrease of the caving zone according to the following formula:

$$\Delta h = M - \frac{P_i - \sigma_{ij}}{\sigma_{ij} - p_i} H$$

Here, $P_i$ refers to the rock stress variation data; $p_i$ refers to the water pressure variation data; $\sigma_{ij}$ refers to the total stress of the caving zone; H refers to the maximum development height of the caving zone; M refers to a mining height where a stress measurement device or a water pressure measurement device locates; $\Delta h$ refers to the height decrease of the caving zone.

In some examples of the present disclosure, the determining module 303 may be further configured to: determine the difference between the height decrease and the surface subsidence variation data as a height of the separation layer of the coal mine.

For the convenience of description, the above device is divided into various modules according to their functions. Of course, in implementing the present disclosure, the functions of each module can be implemented in the same or more software and/or hardware.

The device of the present disclosure is used to realize the method for determining a development status of a separation layer in a coal mine in accordance with any of the above examples, and has the beneficial effects of the corresponding method, which will not be repeated here.

Examples of the present disclosure also provides an electronic device, which includes a memory, a processor, and a computer program stored in the memory and executable on the processor, the processor executes the program to implement the method for determining a development status of a separation layer in a coal mine.

Figure 4:
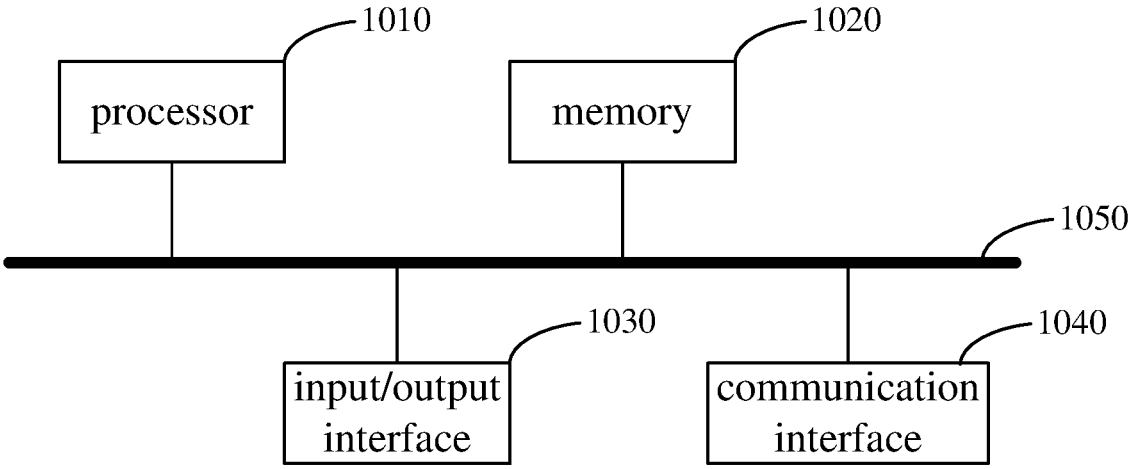
FIG. 4 is a schematic diagram illustrating a structure of an electrical device according to an example of the present disclosure.

FIG. 4 is a schematic diagram illustrating a structure of an electronic device according to some examples of the present disclosure. As shown in FIG. 10, the electronic device may include: a processor 1010, a memory 1020, an input/output interface 1030, a communication interface 1040, and a bus 1050. The processor 1010, the memory 1020, the input/output interface 1030, and the communication interface 1040 may couple to each other via the bus 1050.

The processor 1010 may execute the relevant procedures by virtue of a general central processing unit (CPU), a microprocessor, an application specific integrated circuit (ASIC), or one or more integrated circuits, so as to implement the technical solution provided by the examples of the description.

The memory 1020 may be implemented by a read only memory (ROM), a random-access memory (RAM), a static memory device and a dynamic memory device, etc. The memory 1020 may store an operating system and other application procedures. When the technical solution provided by the example of the description is implemented via the software or the hardware, the related procedure codes are stored in the memory 1020 and revoked by the processor 1010.

The I/O interface 1030 is used for connecting an I/O unit to realize information input and output. The I/O unit may be configured in the device (not in the figure) as a component configuration, and may be externally connected to the device to provide the corresponding functions. The input device may include keyboard, mouse, touch screen, microphone and various sensors. The output device may include display, loudspeaker, vibrator and indicator lamp.

A communication interface 1040 is used for connecting a communication unit (not shown in the figure) to realize communication interaction between the device and other devices. The communication unit may realize communication in a wired manner (for example, USB, wire, etc.) or in a wireless manner (for example, mobile network, WIFI, Bluetooth, etc.).

The bus 1050 includes a passage which transmits information among various components (for example, the processor 1010, the memory 1020, the I/O interface 1030 and the communication interface 1040) on the device.

It should be noted that, although the above-mentioned device merely shows the processor 1010, the memory 1020, the I/O interface 1030, the communication interface 1040 and the bus 1050, the device may further include other components required by the normal operation in the specific implementation process. Besides, those skilled in the art could appreciate that the above-mentioned device may merely include the components required by the solution in the examples of the Description, but not necessarily include all components shown in the figure.

The above-mentioned device of the present disclosure is used to realize the method for determining a development status of a separation layer in a coal mine in accordance with any of the above examples, and has the beneficial effects of the corresponding method, which will not be repeated here.

The computer readable medium in the example includes volatile, non-volatile, movable and non-movable media, which can realize information storage by any method or technology. The information can be computer readable instruction, data structure, program unit or other data. The example of computer storage media includes, but not limited to phase-change memory (PRAM), static random access memory (SRAM), dynamic random access memory (DRAM), other types of random access memory (RAM), read only memory (ROM), electrically erasable programmable read-only memory (EEPROM), flash memory or other memory technologies, compact disk read only memory (CD-ROM), digital versatile disc (DVD) or other optical memories, cassette magnetic tape, tape, disk memory or other magnetic memory device or any other non-transmission media, and available for storing information accessible by the computing devices.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. For example, other memory architectures, such as dynamic RAM (DRAM), may use the examples discussed.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A method for determining a development status of a separation layer in a coal mine, comprising:

obtaining surface subsidence variation data of the coal mine within a preset time interval by a rock movement monitoring station set on a ground surface of the coal mine or by at least one Unmanned Aerial Vehicle;

obtaining rock stress variation data of a caving zone corresponding to the ground surface of the coal mine by a stress measurement device buried in the caving zone;

obtaining water pressure variation data of the caving zone corresponding to the ground surface of the coal mine by a water pressure measurement device buried in the caving zone;

determining a height decrease of the caving zone based on the rock stress variation data and the water pressure variation data, comprising:

calculating a maximum development height of the caving zone:

$$P = \sum_{i=1}^{n} \gamma_i s_i$$

$$H = \sum_{i=1}^{n-1} s_i + \frac{P_0 - P}{\gamma_n}$$

wherein, P refers to an intensity of pressure of the caving zone, in Pa; $\gamma_i$ refers to a unit weight of a $i^{th}$ layer of the caving zone, in N/m3; $s_i$ refers to a thickness of the $i^{th}$ layer of the caving zone, in m; n refers to a total number of layers of the caving zone; $P_0$ refers to a stable intensity of pressure that a bottom plate of the caving zone experiences within the preset time interval; $\gamma_n$ refers to a unit weight of a $n^{th}$ layer of the collapsed rock mass; and H refers to the maximum development height of the caving zone;

calculating a total stress of the caving zone based on the maximum development height:

$$r_0 = \frac{M}{H + M} \times 100\%$$

$$\sigma_{ij} = (1 - r_0)P_0 + r_0 p_0$$

wherein, M refers to a mining height from the ground surface to a position of the stress measurement device or the water pressure measurement device; H refers to the maximum development height of the caving zone; $r_0$ refers to an initial porosity of blocks within a cubic a range of a cube occupied by a goaf of the coal mine; $P_0$ refers to the stable intensity of pressure that a bottom plate of the caving zone experiences within the preset time interval; $p_0$ refers to a pore water pressure in the goaf when the maximum development height of the caving zone is reached; $\sigma_{ij}$ refers to the total stress of the caving zone;

calculating the height decrease of the caving zone based on the total stress:

$$\Delta h = M - \frac{P_i - \sigma_{ij}}{\sigma_{ij} - p_i} H$$

wherein, $P_i$ refers to the rock stress variation data; $p_i$ refers to the water pressure variation data; $\sigma_{ij}$ refers to the total stress of the caving zone; H refers to the maximum development height of the caving zone; M refers to a mining height where a stress measurement device or a water pressure measurement device locates; $\Delta h$ refers to the height decrease of the caving zone;

in response to determining a difference between the height decrease and the surface subsidence variation data is less than a preset threshold, determining the development status of the separation layer is an undeveloped status; and in response to determining the difference between the height decrease and the surface subsidence variation data is larger than the preset threshold, determining the development status of the separation layer is a developed status; determining a development degree of the separation layer according to the difference between the height decrease and the surface subsidence variation data; and in response to determining the development degree reaches a preset early warning threshold, taking control measures for the caving zone to avoid occurrences of water damages.

2. The method according to claim 1, wherein, obtaining surface subsidence variation data of the coal mine within a preset time interval comprises:

determining a first coordinate of the ground surface of the coal mine at a starting time of the preset time interval;

determining a second coordinate of the ground surface of the coal mine at an end time of the preset time interval; and obtaining the surface subsidence variation data according to the first coordinate and the second coordinate.

3. The method according to claim 1, after determining the development status is the developed status in response to determining the difference between the height decrease and the surface subsidence variation data is larger than the preset threshold, further comprising:

taking the difference between the height decrease and the surface subsidence variation data as a height of the separation layer of the coal mine; and taking height of the separation layer of the coal mine as the development degree of the separation layer.

4. An electronic device, comprising: a memory, a processor, and a computer program stored in the memory and executable on the processor, wherein the processor executes the program to implement the method for determining a development status of a separation layer in a coal mine according to claim 1.

5. A non-transitory computer-readable storage medium, storing a computer instruction, wherein the computer instruction is used to make a computer execute the method according to claim 1.

* * * * *